US008785896B2

(12) United States Patent
Kawahara

(10) Patent No.: US 8,785,896 B2
(45) Date of Patent: Jul. 22, 2014

(54) RADIOACTIVE CONTAMINANT CONTAINER

(71) Applicant: Kawahara Technical Research Co., Ltd., Tokyo (JP)

(72) Inventor: Satoshi Kawahara, Tokyo (JP)

(73) Assignee: Kawahara Technical Reserch Co., Ltd., Tokyo (JP)

( * ) Notice: Subject to any disclaimer, the term of this patent is extended or adjusted under 35 U.S.C. 154(b) by 0 days.

(21) Appl. No.: 14/032,939

(22) Filed: Sep. 20, 2013

(65) Prior Publication Data

US 2014/0077105 A1 Mar. 20, 2014

(30) Foreign Application Priority Data

Sep. 20, 2012 (JP) ..... 2012-207384

(51) Int. Cl.
*G21F 5/015* (2006.01)

(52) U.S. Cl.
CPC ..... *G21F 5/015* (2013.01)
USPC ..... 250/507.1

(58) Field of Classification Search
USPC ..... 250/507.1
See application file for complete search history.

(56) References Cited

U.S. PATENT DOCUMENTS 4,955,983 A * 9/1990 Meess et al. ..... 405/129.57

FOREIGN PATENT DOCUMENTS

AU 778483 B2 7/2002
CN 102392090 A 3/2012

OTHER PUBLICATIONS

Communication, dated Jan. 20, 2014, issued in corresponding EP Application No. 13185142.0, 8 pages in English.

* cited by examiner

*Primary Examiner* — Kiet T Nguyen
(74) *Attorney, Agent, or Firm* — Sughrue Mion, PLLC

(57) ABSTRACT

Disclosed is a radioactive contaminant container including a wall that defines a containing space for containing radioactive contaminants and shields at least a portion of radiation irradiated from the radioactive contaminants, and the wall has an outer shape of a hexagonal cylinder or a substantially hexagonal cylinder.

11 Claims, 11 Drawing Sheets

RADIOACTIVE CONTAMINANT CONTAINER

BACKGROUND OF THE INVENTION

1. Field of the Invention

The present invention relates to a container, and particularly relates to a radioactive contaminant container for containing radioactive contaminants.

2. Background Art

In the related art, a radioactive contaminant container for safely containing radioactive contaminants has been known (for example, refer to Japanese Unexamined Patent Application Publication No. 2007-147580). Japanese Unexamined Patent Application Publication No. 2007-147580 discloses a mobile radiation shielding container formed in order to safely reserve radioactive wastes generated in a medical field for waste treatment or to store radioactive materials. The mobile radiation shielding container is a heavy radiation shielding container formed by heavy metals such as lead in order to contain a radioactive waste introducing receptacle or a radioactive material storing bucket. The radiation shielding container disclosed in Japanese Unexamined Patent Application Publication No. 2007-147580 has an opening and closing lid on an upper surface or a lateral surface thereof in order to insert the radioactive waste introducing receptacle. The upper surface of the lid of the radiation shielding container has an introducing hole for introducing the radioactive waste into the radioactive waste introducing receptacle, and is formed to cover a surface of the introducing hole with the lid for shielding radiation generated from the inside. In order for the radiation shielding container to be movable, a caster is attached to a lower portion of the radiation shielding container.

SUMMARY OF THE INVENTION

However, the mobile radiation shielding container disclosed in Japanese Unexamined Patent Application Publication No. 2007-147580 is proposed on the premise that the container is used in a medical field, and is not intended to store a large amount of radioactive contaminants. For example, when an accident of a nuclear power plant results in a large amount of the radioactive contaminants, all of the radioactive contaminants cannot be immediately purified. Accordingly, it becomes necessary to store the radioactive contaminants for temporary isolation from a living space or for permanent isolation for the purpose of disposal. When the mobile radiation shielding container disclosed in Japanese Unexamined Patent Application Publication No. 2007-147580 is used to store a large amount of the radioactive contaminants, lead is used in the mobile radiation shielding container in order to enhance radiation shielding efficiency. Accordingly, it is apprehended that the lead adversely affects the environment.

In addition, in order to move a container which becomes heavy due to use of heavy metals such as lead, a caster is attached to the above-described mobile radiation shielding container. Therefore, when the mobile radiation shielding container disclosed in Japanese Unexamined Patent Application Publication No. 2007-147580 is used to store the radioactive contaminants, it is necessary to have an extra space inside a storing space in order to contain the caster portion. In addition, in order to store a large amount of the radioactive contaminants, it is necessary to provide many containers. In this case, in order to save the storing space, it is required to store the containers by stacking the container thereon. However, since the mobile radiation shielding container disclosed in Japanese Unexamined Patent Application Publication No. 2007-147580 has the attached caster, it is difficult to safely stack the container thereon.

Therefore, the present invention aims to provide a radioactive contaminant container which can enhance radiation shielding efficiency even by using materials of low environmental load and can save a storing space, when storing radioactive contaminants by using multiple containers.

In order to achieve the above-described object, a radioactive contaminant container according to the present invention includes a wall that defines a containing space for containing radioactive contaminants and shields at least a portion of radiation irradiated from the radioactive contaminants, and the wall has an outer shape of a hexagonal cylinder or a substantially hexagonal cylinder. The term "radioactive contaminants" means a substance contaminated by radioactive substances.

The term "wall" does not depend on a positional relationship when the radioactive contaminant container is placed on a predetermined plane. For example, when the radioactive contaminant container is placed on a predetermined plane so that an axial direction of the hexagonal cylinder or the substantially hexagonal cylinder is perpendicular to the plane, the wall is configured to include all of an upper surface, a lateral surface and a bottom surface of the hexagonal cylinder or the substantially hexagonal cylinder. Similarly, for example, even when the radioactive contaminant container is placed on a predetermined plane so that the axial direction of the hexagonal cylinder or the substantially hexagonal cylinder is parallel to the plane, the wall is configured to include all of the upper surface, the lateral surface and the bottom surface of the hexagonal cylinder or the substantially hexagonal cylinder.

For example, the wall includes a first protrusion extending along the axial direction of the hexagonal cylinder or the substantially hexagonal cylinder and protruding outward; and a first recess extending along the axial direction and recessed inward, and the first recess can be fitted to the first protrusion formed in the other radioactive contaminant container.

In the description of the invention, the term "outward side" represents a farther side from the center of the radioactive contaminant container unless otherwise described, and the term "inward side" represents a closer side from the center of the radioactive contaminant container unless otherwise described.

As an example, the wall may include a first surface and a second surface, each extending in a direction intersecting with the axial direction of the hexagonal cylinder or the substantially hexagonal cylinder, and each shape being hexagonal or substantially hexagonal. Any one surface of the first surface and the second surface may include a second protrusion protruding outward, and the other surface may include a second recess recessed inward. The second recess may be fitted to the second protrusion formed in the other radioactive contaminant container.

The wall may include a metal plate having multiple through-holes. For example, a portion of the wall may be formed to be attachable to and detachable from the other portion of the wall, or to be openable and closeable in order to contain the radioactive contaminants in the containing space.

As an example, the wall may include a layer containing radiation shielding materials having at least silicon, strontium, magnesium, europium and dysprosium as essential elements. The wall may further include a layer formed of stainless steel. The layer containing the radiation shielding materials may be a layer in which the radiation shielding materials are added to resin or rubber. As another example, the wall may be formed of stainless steel.

For example, the radioactive contaminant container according to the present invention may contain a reverse osmosis membrane used to purify radioactively contaminated water. In addition, a radioactive contaminant container according to the present invention may be configured such that a containing space for containing radioactive contaminants contains multiple radioactive contaminant containers according to the present invention.

As an example, the first recess may be disposed on three surfaces which are not adjacent to each other within six surfaces extending in the axial direction of the hexagonal cylinder or the substantially hexagonal cylinder, and a handle for attaching a wire rope for transportation may be disposed in the first recess.

In a radioactive contaminant container according to the present invention, since a wall has an outer shape of a hexagonal cylinder or a substantially hexagonal cylinder, when multiple radioactive contaminant containers are juxtaposed, it is possible to juxtapose the adjacent radioactive contaminant containers by bringing the containers into close contact with each other. In addition, the radioactive contaminant containers can be not only juxtaposed, but also stacked. Therefore, when storing the radioactive contaminant containers containing radioactive contaminants, it is possible to save storing space for the radioactive contaminant containers, which is disposed under the ground or on the ground.

In addition, it is possible to juxtapose or stack the radioactive contaminant containers by bringing the containers into close contact with each other. Accordingly, a radiation shielding function obtained by the wall is enhanced by increased thickness at horizontally or vertically adjacent places of the two walls. This can further reduce air dose inside the container and the storing space of the radioactive contaminant container. That is, in order to enhance radiation shielding efficiency of the radioactive contaminant container, it is not necessary to form the radioactive contaminant container by using lead which adversely affects the environment. If the multiple radioactive contaminant containers according to an aspect of the present invention are brought into close contact with each other and are juxtaposed or stacked, it is possible to further enhance the radiation shielding efficiency.

In this manner, according to the radioactive contaminant container of the present invention, the radiation shielding efficiency can be enhanced even by using materials of low environmental load and a storing space can be saved, when storing the radioactive contaminants by using the multiple radioactive contaminant containers.

If the wall includes the first protrusion extending along the axial direction of the hexagonal cylinder or the substantially hexagonal cylinder and protruding outward; and the first recess extending along the axial direction and recessed inward, and if the first recess can be fitted to the first protrusion formed in the other radioactive contaminant container, when juxtaposing multiple radioactive contaminant containers, it is possible to connect the multiple radioactive contaminant containers according to an aspect of the present invention by allowing the first protrusion and the first recess of the adjacent radioactive contaminant containers to be fitted to each other.

Therefore, the multiple radioactive contaminant containers can be further brought into close contact with each other and can be stably stored. In addition, by connecting the radioactive contaminant containers to each other, it is possible to reduce a risk that the radioactive contaminant containers may fall down due to a shock of an earthquake.

If any one surface of the first surface and the second surface in the wall, each shape of which is hexagonal or substantially hexagonal, includes a second protrusion protruding outward, and the other surface includes a second recess recessed inward, and if the second recess can be fitted to the second protrusion formed in the other radioactive contaminant container, when stacking multiple radioactive contaminant containers, it is possible to allow the second protrusion of the lower radioactive contaminant container to be fitted to the second recess of the upper radioactive contaminant container.

Therefore, even when the radioactive contaminant containers are stacked, the multiple radioactive contaminant containers can be further brought into close contact with each other, and can be stably stored by connecting the upper and lower containers. Accordingly, it is possible to reduce a risk that the radioactive contaminant containers may fall down due to a shock of an earthquake.

If the wall is configured to include the metal plate having multiple through-holes, strength of the wall is increased. In addition, since the metal plate has the multiple through-holes, even when a stretching force, a compression force or an impact is applied to the wall, it is possible to mitigate these forces. Therefore, it is possible to increase overall strength of the radioactive contaminant container. As an example, the term "metal plate having multiple through-holes" represents a metal mesh plate.

If in order to contain the radioactive contaminants in the containing space, a portion of the wall is formed to be attachable to and detachable from the other portion of the wall or to be openable and closeable, a portion of the wall functions as a lid. Accordingly, it is possible to facilitate introducing and containing of the radioactive contaminants.

If the wall includes the layer containing the radiation shielding materials having at least silicon, strontium, magnesium, europium and dysprosium as essential elements, it is possible to further enhance the radiation shielding function of the radioactive contaminant container by using the radiation shielding materials of the low environmental load. Similarly, if the layer containing the radiation shielding materials is a layer in which the radiation shielding materials are added to resin or rubber, it is also possible to further enhance the radiation shielding function of the radioactive contaminant container by using the radiation shielding materials of the low environmental load.

If the wall is configured to further include a layer formed of stainless steel or the wall is formed of the stainless steel, since the wall is unlikely to rust, the strength of the wall can be maintained. In addition, it is possible to further enhance the radiation shielding function.

If the radioactive contaminant container according to the present invention is configured to contain a reverse osmosis membrane (RO membrane) used to purify radioactively contaminated water, it is possible to contain and store the reverse osmosis membrane (RO membrane) which becomes the radioactive contaminants through the purification of the radioactively contaminated water, in the radioactive contaminant container having the radiation shielding function.

If the containing space of the radioactive contaminant container according to the present invention is configured to contain other multiple radioactive contaminant containers according to the present invention, the radioactive contaminants contained inside the multiple radioactive contaminant containers are doubly contained in the radioactive contaminant container. Accordingly, it is possible to further enhance the radiation shielding efficiency. Furthermore, the outer shape of the wall in the radioactive contaminant container containing the multiple containers is the hexagonal cylinder or the substantially hexagonal cylinder. Accordingly, the thickness of the wall of the adjacent places is increased by the juxtaposition. Therefore, as described above, it is possible to further enhance the radiation shielding efficiency.

If the first recess is disposed on three surfaces which are not adjacent to each other within six surfaces extending in the axial direction of the hexagonal cylinder or the substantially hexagonal cylinder, and if the handle for attaching the wire rope for transportation is disposed in the first recess, when lifting, transporting and installing the radioactive contaminant container, the radioactive contaminant container can be lifted, transported and installed with a good balance.

BRIEF DESCRIPTION OF THE DRAWINGS

FIG. 10 is a plan view illustrating the radioactive contaminant container according to the first embodiment which contains multiple radioactive contaminant containers according to a second embodiment.

FIG. 13 is a plan view illustrating the radioactive contaminant container according to the first embodiment which is configured to contain multiple radioactive contaminant containers according to the second embodiment which have a different size from an example illustrated in FIG. 10.

FIG. 14 is a perspective view of a radioactive contaminant container according to another embodiment.

FIG. 15 is a perspective view of the radioactive contaminant container according to another embodiment.

FIG. 16 is a plan view of a radioactive contaminant container according to further another embodiment.

DETAILED DESCRIPTION OF THE INVENTION

First Embodiment

Figure 1:
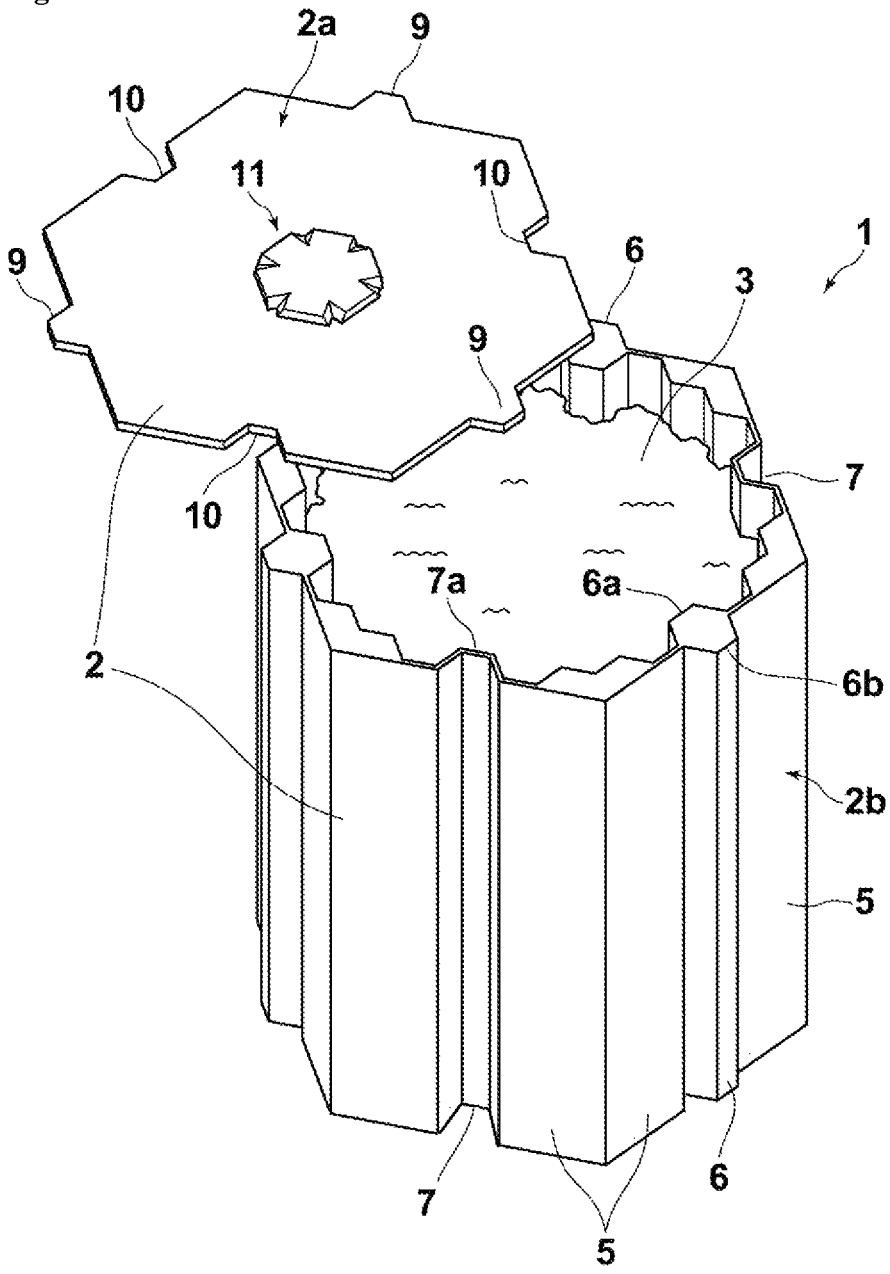
FIG. 1 is a perspective view of a radioactive contaminant container according to a first embodiment.
Figure 2:
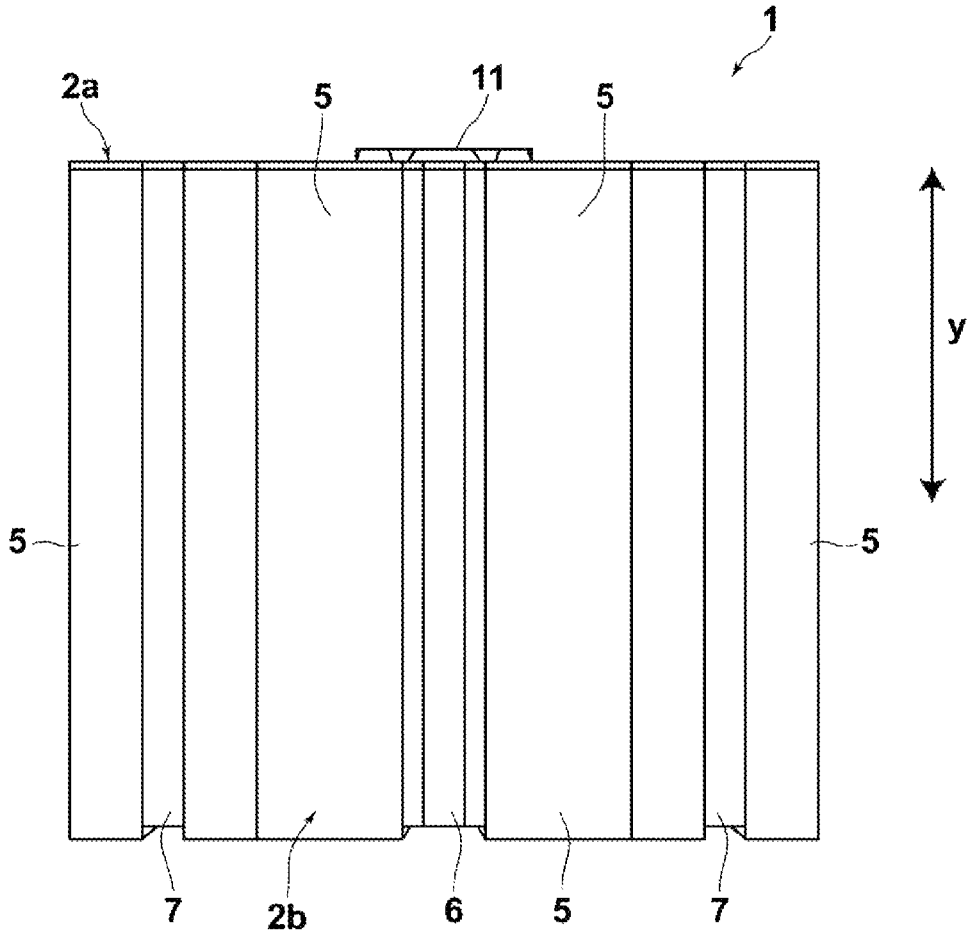
FIG. 2 is a front view of a radioactive contaminant container according to the first embodiment.

Hereinafter, an embodiment of the present invention will be described with reference to the accompanying drawings. FIG. 1 illustrates a perspective view of a radioactive contaminant container according to the first embodiment, and FIG. 2 illustrates a front view of the radioactive contaminant container 1. A radioactive contaminant container 1 includes walls 2 which define a containing space for containing radioactive contaminants 3 such as radioactively contaminated soil and radioactively contaminated ashes. The walls 2 shield at least a portion of radiation irradiated from the radioactive contaminants 3. The walls 2 of the radioactive contaminant container 1 have an outer shape of a substantially hexagonal cylinder.

The walls 2 include a detachable lid 2*a* disposed to be capable of introducing the radioactive contaminants 3 and a main body 2*b*. In the radioactive contaminant container 1 according to the first embodiment, as illustrated in FIG. 2, in a positional relationship when the walls 2 of the substantially hexagonal cylinder are placed in an upright position so that an axial direction y is perpendicular to a placement surface, the wall 2 configuring an upper surface of the substantially hexagonal cylinder is the lid 2*a*, and the wall 2 configuring a bottom surface and lateral surfaces is the main body 2*b*.

In the radioactive contaminant container 1 according to the first embodiment, since widths of lateral surfaces 5 of the main body 2*b* (width in a direction perpendicular to the axial direction y) are coincidental with each other, the walls 2 have the outer shape of a substantially regular hexagonal cylinder. In the radioactive contaminant container 1 according to the first embodiment, as an example, a length in the axial direction of the substantially regular hexagonal cylinder configured to have the outer shape of the walls 2 is approximately 1 m, and a length of a diagonal line passing through a center of the substantially regular hexagon in a plane of the substantially regular hexagon is approximately 1 m.

As illustrated in FIGS. 1 and 2, each lateral surface 5 of the main body 2*b* has either a lateral surface protrusion 6 extending along the axial direction y of the substantially hexagonal cylinder or a lateral surface recess 7 extending along the axial direction. In the radioactive contaminant container 1 according to the first embodiment, the lateral surface protrusion 6 or the lateral surface recess 7 is arranged in the center of each lateral surface 5. The lateral surface 5 having the lateral surface protrusion 6 and the lateral surface 5 having the lateral surface recess 7 are configured to be adjacent to each other.

As illustrated in FIG. 1, the lateral surface protrusion 6 includes an outward protrusion 6*b* protruding outward from the radioactive contaminant container 1 and an inward protrusion 6*a* protruding inward to the radioactive contaminant container 1. The outward protrusion 6*b* is formed so that the width becomes narrower as it goes outward, and the inward protrusion 6*a* is formed so that the width becomes narrower as it goes inward.

The lateral surface recess 7 is formed so that the width becomes narrower as it goes inward to the radioactive contaminant container 1. In the radioactive contaminant container 1 according to the first embodiment, when multiple radioactive contaminant containers 1 are juxtaposed, the outward protrusion 6*b* can be fitted to the lateral surface recess 7 disposed on the other radioactive contaminant container 1.

The lid 2*a* has a lid protrusion 9 corresponding to the shapes of the lateral surface protrusion 6 and the lateral surface recess 7, and a lid recess 10. When the lid 2*a* is attached to the main body 2*b*, the lid protrusion 9 is formed so that an outer edge thereof matches the outward protrusion 6*b*, and the lid recess 10 is formed so that the outer edge matches the lateral surface recess 7. A lid center projection 11 projecting outward from the radioactive contaminant container 1 is formed in the center of the lid 2*a*.

Figure 3:
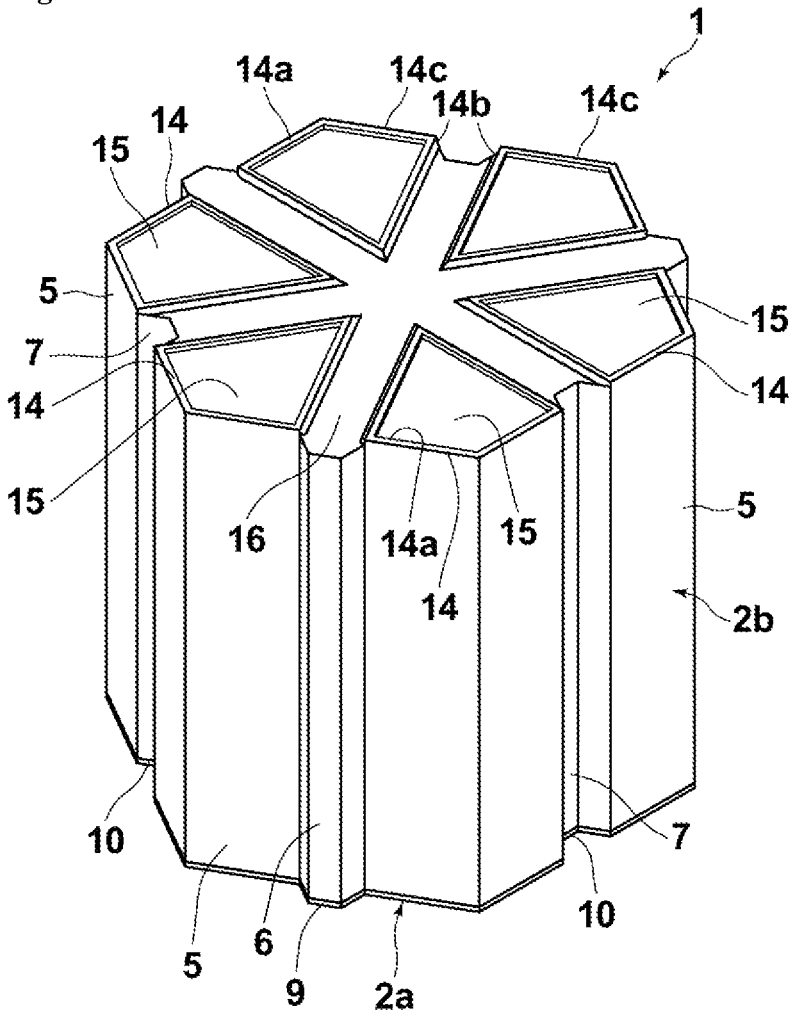
FIG. 3 is a perspective view of the radioactive contaminant container according to the first embodiment.
Figure 4:
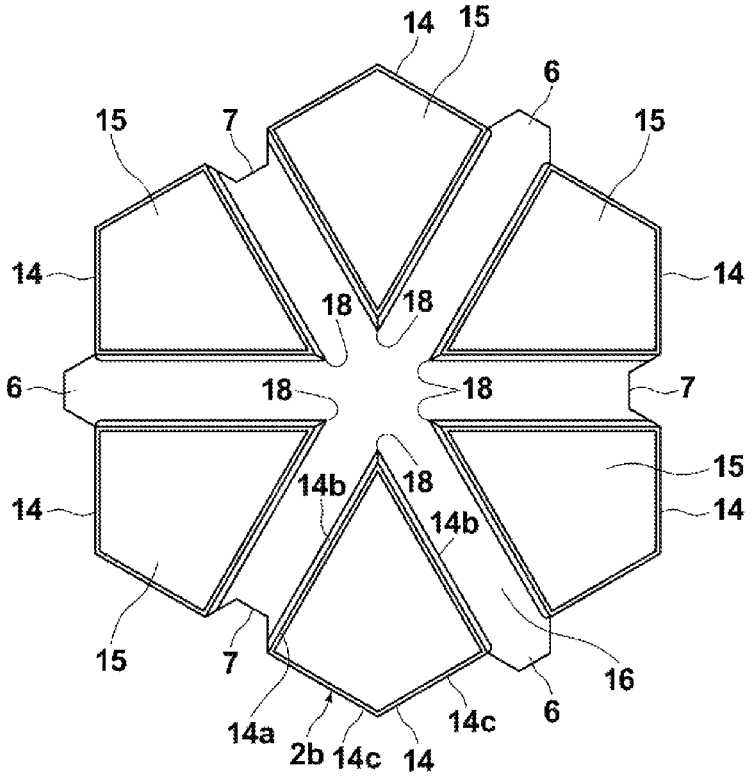
FIG. 4 is a bottom view of the radioactive contaminant container according to the first embodiment.

In a positional relationship illustrated in FIG. 1, when the radioactive contaminant container 1 is placed on any plane, the lateral surface protrusion 6 and the lateral surface recess 7 are formed to have a gap with the plane. FIG. 3 illustrates a perspective view when viewed from a bottom surface direction of the radioactive contaminant container 1, and FIG. 4 illustrates a bottom view. The bottom surface has a bottom surface projection 14. The bottom surface projection 14 is continuously formed from an edge portion of the lateral surface 5 where the lateral surface protrusion 6 and the lateral surface recess 7 are not formed.

The bottom surface projection 14 is formed at each substantially hexagonal corner which appears on the bottom surface of the radioactive contaminant container 1. As illustrated in FIG. 3, in a positional relationship where the radioactive contaminant container 1 is arranged so that the bottom surface is placed to face upward, the bottom surface projection 14 includes an upper surface 14*a* formed on the same plane, a pair of first lateral walls 14*b* extending toward a direction of the center from an edge portion of the radioactive contaminant container 1, and a pair of second lateral walls 14*c* formed integrally with the lateral surface 5. A plane 15 formed in an inner side surrounded by the bottom surface projection 14 and a plane 16 formed in an outer side of the bottom surface projection 14 are on the same plane. The upper surface 14*a* of the bottom surface projection 14 is located further in the outer side of the radioactive contaminant container 1 than the plane 15 and the plane 16, and extends parallel to the plane 15 and the plane 16.

The first lateral wall 14*b* is disposed to be tilted to the plane 15 and the plane 16. The first lateral wall 14*b* is tilted so that a cross-sectional surface of the bottom surface projection 14 becomes narrower as it goes outward from the radioactive contaminant container 1. As illustrated in FIG. 4, a pair of the first lateral walls 14*b* mutually extends to the direction of the center and comes into contact with each other to form a corner portion 18 at the junction. When the radioactive contaminant containers 1 are stacked on one another, a recess of the bottom surface which is formed by the bottom surface projection 14 and the plane 16 is formed so as to be fitted to the lid center projection 11 formed in the radioactive contaminant container 1.

Figure 5:
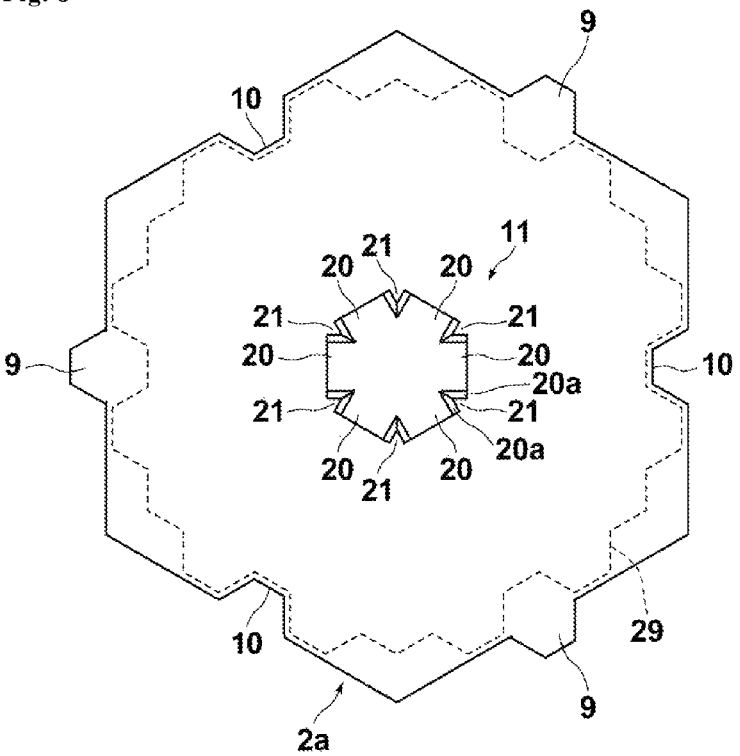
FIG. 5 is a plan view of the radioactive contaminant container according to the first embodiment.

FIG. 5 illustrates a plan view of the lid 2*a*. The lid center projection 11 includes a projection 20 of a substantially regular hexagonal cylinder which has a predetermined height width, and a notched portion 21 formed at a corner portion which is the regular hexagon when the projection 20 is viewed from the upper surface. When the radioactive contaminant containers 1 are stacked on one another, the corner portion 18 of the bottom surface projection 14 is fitted to the notched portion 21. A pair of lateral walls 20*a* of the projection 20 is tilted so that a pair of the lateral walls 20*a* of the projection 20, which defines a pair of the first lateral walls 14*b* forming the corner portion 18, and the notched portion 21 is in close contact with each other.

Figure 6:
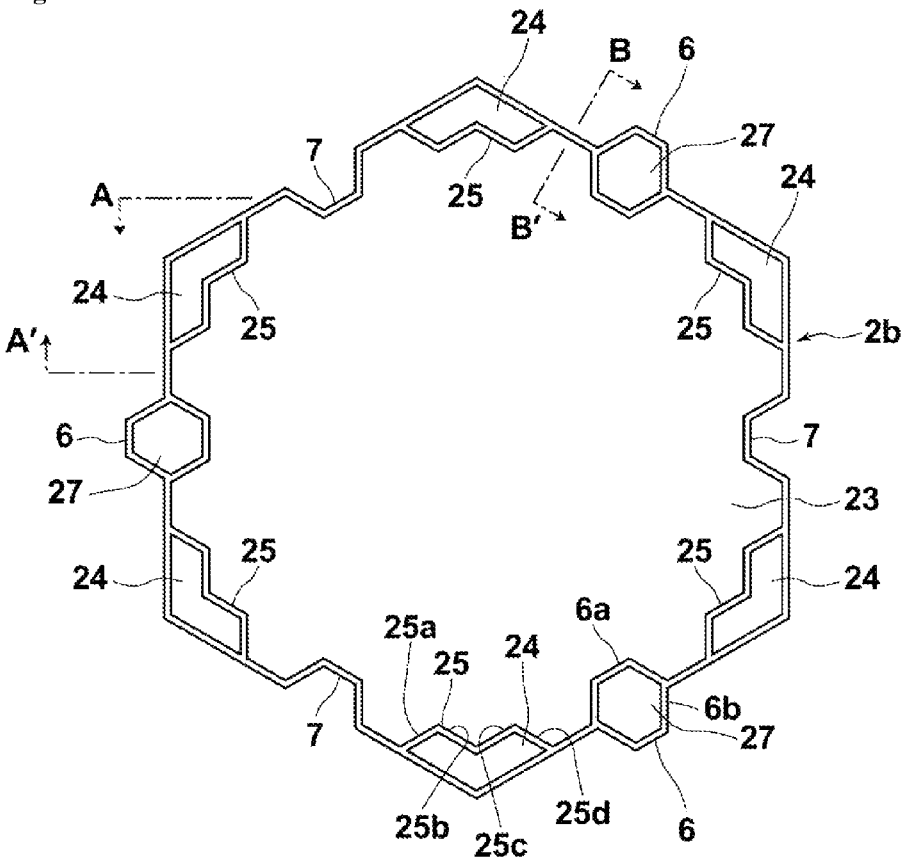
FIG. 6 is a plan view illustrating an opening shape of the radioactive contaminant container according to the first embodiment.

Next, FIG. 6 illustrates an opening shape of the main body 2*b* when the lid 2*a* is opened. The outer shape of the cross-sectional surface of the lateral surface protrusion 6 in a width direction (cross-sectional surface perpendicular to the axial direction y) is hexagonal, and in the opening of the main body 2*b*, the outer shape of an end surface of the lateral surface protrusion 6 is hexagonal. Among sides configuring the hexagon, three sides protruding inward are configured to have inward protrusions 6*a*, and three sides protruding outward are configured to have outward protrusions 6*b*. In the opening of the main body 2*b*, the lateral surface recesses 7 appear as an end surface of three consecutive sides. The shape of the inner wall surface of the inward protrusion 6*a* and the shape of the inner wall surface of the lateral surface recess 7 are coincidental with each other.

In addition, in the inner side of each substantially hexagonal corner portion which appears on the opening surface, an inner wall 25 extending along the axial direction y of the radioactive contaminant container 1 is disposed. As illustrated in FIG. 6, the inner wall 25, when viewed from the opening surface, includes a first inner wall 25*a* extending inward from the inner side wall surface of the lateral surface 5, a second inner wall 25*b* formed continuously with the first inner wall 25*a* and extending parallel to the opposed lateral surface 5, a third inner wall 25*c* formed continuously with the second inner wall 25*b* and extending parallel to the opposed lateral surface 5, and a fourth inner wall 25*d* extending between the third inner wall 25*c* and the lateral surface 5.

A space 24 is defined between the inner wall 25 and the lateral surface 5. In the lateral surface protrusion 6, a space 27 is defined between a wall surface configuring the inward protrusion 6*a* and a wall surface configuring the outward protrusion 6*b*. Since the space 24 and the space 27 are disposed, it is possible to further reduce the weight of the radioactive contaminant container 1 as compared to a case where these spaces are filled.

The containing space 23 of the radioactive contaminant container 1 is defined by the inner wall surface of a portion of the lateral surface 5 and the inner wall surface of the inner wall 25 and the inward protrusion 6*a* which are extended from the portion of the lateral surface 5. As illustrated in FIG. 5, a rear surface of the lid 2*a* has a lid placing projection 29 which is fitted to the inside of the inner wall surface defining the containing space 23 when the main body 2*b* is closed by the lid 2*a*, that is, the inside of the inner wall surface of the portion of the lateral surface 5 and the inner wall surface of the inner wall 25 and the inward protrusion 6*a* which are extended from the portion of the lateral surface 5. In a plan view illustrating a surface of the lid 2*a* in FIG. 5, the lid placing projection 29 disposed on the rear surface of the lid 2*a* is virtually illustrated. When the lid 2*a* is used for closing, it is possible to stably place the lid 2*a* on the main body 2*b* by using the lid placing projection 29.

Figure 7:
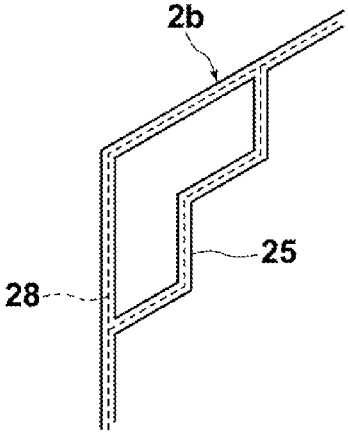
FIG. 7 is a partially enlarged view of the radioactive contaminant container according to the first embodiment along a line A-A' in FIG. 6.

In the radioactive contaminant container 1 according to the first embodiment, the walls 2 configuring the radioactive contaminant container 1 are reinforced, thereby increasing the strength of the radioactive contaminant container 1. FIG. 7 illustrates an enlarged view of a portion along the line A-A' illustrated in FIG. 6. A reinforcing metal plate 28 having multiple through-holes is embedded on the lateral surface 5 of the main body 2*b* and inside the inner wall 25. The thickness widths of the lateral surface 5 of the main body 2*b* in which the reinforcing metal plate 28 is embedded and the inner wall 25 are respectively 10 mm as an example. Multiple circular through-holes are arranged in regular mesh in the reinforcing metal plate 28. As an example, the reinforcing metal plate 28 is a metal mesh plate. Since the reinforcing metal plate 28 has the multiple through-holes, even when a stretching force, a compression force or an impact is applied thereto, it is possible to mitigate these forces.

In the radioactive contaminant container 1 according to the first embodiment, the reinforcing metal plate 28 is also embedded along the lid 2*a* and the bottom surface inside the lid 2*a* and the bottom surface. The reinforcing metal plate 28 is also embedded inside the lid center projection 11, the bottom surface projection 14, the lateral surface protrusion 6 and the lateral surface recess 7. That is, in the radioactive contaminant container 1 according to the first embodiment, the reinforcing metal plate 28 is embedded throughout the entire walls 2.

Figure 8:
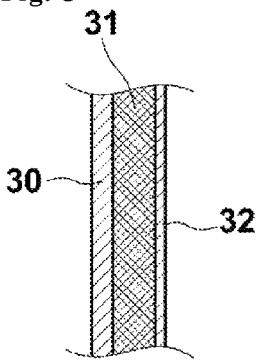
FIG. 8 is an enlarged cross-sectional view of the radioactive contaminant container according to the first embodiment along a line B-B' in FIG. 6.

FIG. 8 illustrates a cross-sectional view along the line B-B' illustrated in FIG. 6. In the cross-sectional view of FIG. 8 along the line B-B', the reinforcing metal plate 28 is not illustrated. As illustrated by the cross-sectional view along the line B-B', in the radioactive contaminant container 1 according to the first embodiment, the walls 2 include multiple layers. An outer layer 30 is formed of stainless steel, an intermediate layer 31 is a layer of a radiation shielding materials which is molded in a plate shape, and an inner layer 32 is formed of stainless steel. The radiation shielding materials have at least silicon, strontium, magnesium, europium and dysprosium as essential elements. The radiation shielding materials will be described later in detail. A width ratio of the outer layer 30, the intermediate layer 31 and the inner layer 32 can be appropriately selected depending on an amount of radiation to be shielded.

Figure 9:
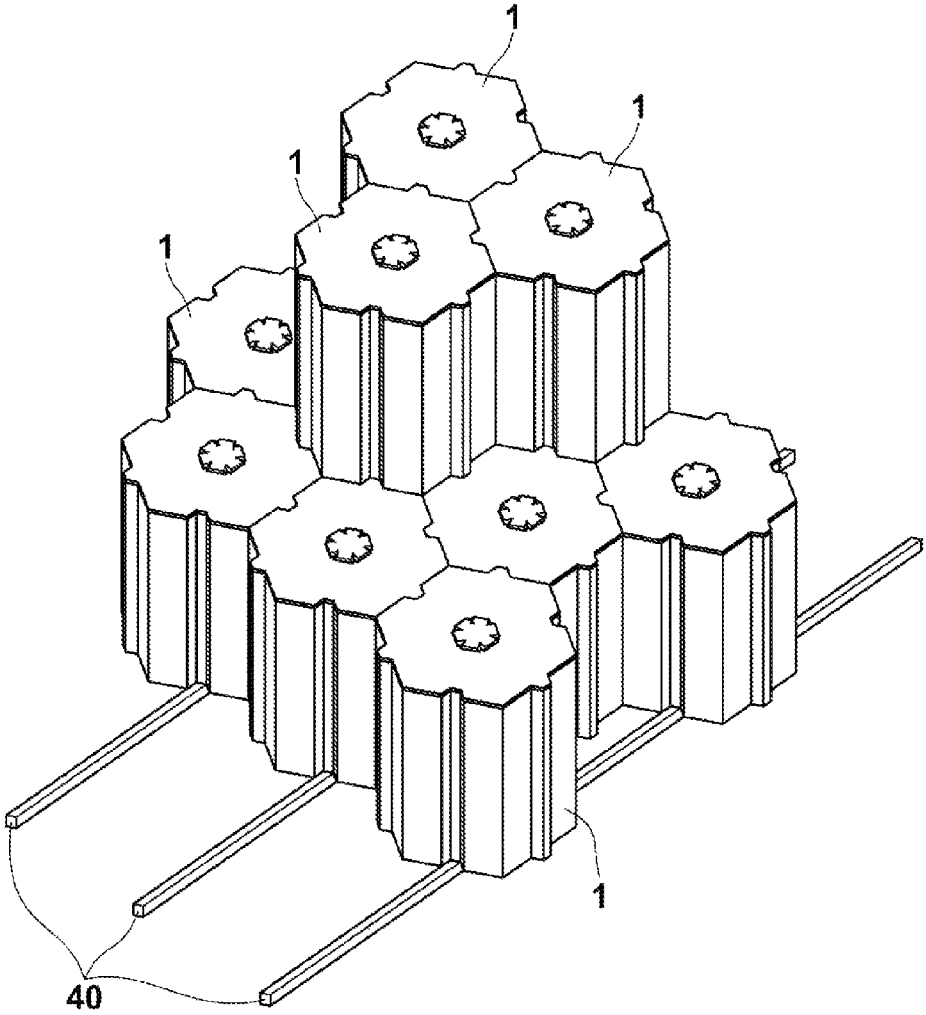
FIG. 9 is a perspective view illustrating a state where radioactive contaminant containers according to the first embodiment are juxtaposed and stacked.
Figure 1:
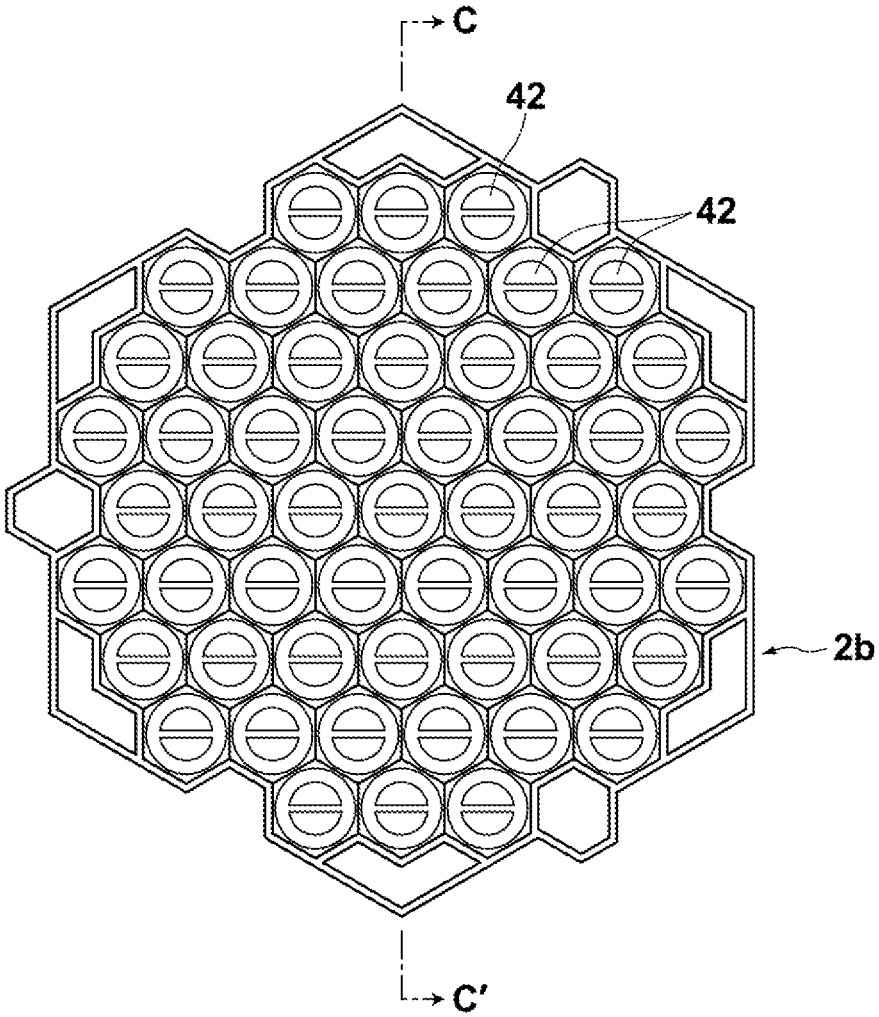

FIG. 9 illustrates a perspective view in a state where multiple radioactive contaminant containers 1 are juxtaposed and stacked. In the radioactive contaminant container 1 according to the first embodiment, the outer shape of the walls 2 is the substantially hexagonal cylinder. Accordingly, when the multiple radioactive contaminant containers 1 are juxtaposed, it is possible to juxtapose or stack the adjacent radioactive contaminant containers 1 by bringing the containers into close contact with each other. Therefore, when storing the radioactive contaminant containers 1 containing the radioactive contaminants 3 (refer to FIG. 1), it is possible to save a storing space for the radioactive contaminant containers 1, which is disposed under the ground or on the ground.

In addition, it is possible to juxtapose or stack the radioactive contaminant containers 1 by bringing the containers into close contact with each other. Accordingly, the thickness is increased at horizontally or vertically adjacent places of the walls 2. Therefore, a radiation shielding function is enhanced by the walls 2. This can further reduce air dose inside the container and the storing space of the radioactive contaminant container 1.

In addition, the lateral surface of the radioactive contaminant container 1 has the outward protrusion 6*b* and the lateral surface recess 7 which can be fitted together. When the multiple radioactive contaminant containers 1 are juxtaposed, the outward protrusion 6*b* and the lateral surface recess 7 of the adjacent radioactive contaminant container 1 are fitted together, thereby enabling the connection between the radioactive contaminant containers 1. Therefore, it is possible to further bring the multiple radioactive contaminant containers 1 into close contact with each other and to stably store the containers.

In addition, by connecting the radioactive contaminant containers 1, it is possible to reduce a risk that the radioactive contaminant containers 1 may fall down due to a shock of an earthquake. In addition, in the radioactive contaminant container 1 according to the first embodiment, the inward protrusion 6*a* is formed inside the outward protrusion 6*b*. Therefore, when the outward protrusion 6*b* and the lateral surface recess 7 of the adjacent radioactive contaminant containers 1 are fitted together, the wall thickness of the fitted portion further becomes thicker than the wall thickness of the other portion. Therefore, it is possible to further enhance the radiation shielding function.

Furthermore, the lid 2*a* and the bottom surface of the radioactive contaminant container 1 have the lid center projection 11 and the multiple bottom surface projections 14. When the multiple radioactive contaminant containers 1 are stacked, the corner portion 18 of the bottom surface projection 14 can be fitted to the notched portion 21 of the lid center projection 11. That is, since the bottom surface projection 14 is formed, the lid center projection 11 can be fitted to a recess of the bottom surface which is formed by the first lateral wall 14*b* of the bottom surface projection 14 and the plane 16. Therefore, even when the radioactive contaminant containers 1 are stacked, the multiple radioactive contaminant containers 1 can be further brought into close contact with each other, and can be stably stored by connecting the upper and lower containers. Accordingly, it is possible to reduce a risk that the radioactive contaminant containers 1 may fall down due to a shock of an earthquake.

Further, as illustrated in FIG. 9, in order to more stably store the containers, multiple container placing rod-shaped members 40 may be arranged in the storage space. The container placing rod-shaped member 40 is fitted to the recess of the bottom surface which is formed by the first lateral wall 14*b* of the bottom surface projection 14 and the plane 16. In this manner, it is possible to more stably juxtapose the lowermost radioactive contaminant container 1.

Radiation Shielding Materials

Hereinafter, the above-described radiation shielding materials will be described in detail. The radiation shielding materials have at least silicon, strontium, magnesium, europium and dysprosium as essential elements. It is possible to shield X-rays in a practicable level by combining the elements. In addition, ultraviolet rays can also be absorbed. Further, since silicate-based compound is used, the specific gravity is lighter than lead and workability is also excellent.

The content of silicon (Si) is preferably 5 to 30 mass %, and more preferably 10 to 20 mass %. The content of strontium (Sr) is preferably 30 to 60 mass %, and more preferably 40 to 50 mass %. The content of magnesium (Mg) is preferably 1 to 20 mass %, and more preferably 5 to 10 mass %. The content of europium (Eu) is preferably 0.1 to 5 mass %, and more preferably 0.5 to 3 mass %. The content of dysprosium (Dy) is preferably 0.1 to 5 mass %, and more preferably 0.5 to 3 mass %.

The above-described radiation shielding materials may contain an oxygen atom (preferably 10 to 50 mass %, and more preferably 20 to 40 mass %) in addition to the above-described essential elements. In addition, a boron atom and a radiation absorbing atom other than the above-described atoms (for example, lanthanoid elements such as erbium) may be contained therein, and further inevitable impurities in production may be contained therein. In view of maleficence, it is preferable that lead elements be not substantially contained therein. For example, the content of the lead is 5 mass % or less, and preferably 1 mass % or less.

The shape of the above-described radiation shielding materials can be appropriately determined depending on the usage of the shielding materials, and for example includes a granular shape (powder), a pellet shape, a block shape, a film shape and a plate shape. The above-described radiation shielding materials can be obtained through powder processing, and can be mixed with other organics (powder shape and fiber shape) to be used in various shielding applications. For example, in a case of the granular shape, an average particle size may be set to 0.1 μm to 1,000 μm, and preferably 1 μm to 100 μm.

In addition, the above-described radiation shielding materials may be independently used as the compound containing the above-described essential elements, or may be used in conjunction with additives such as water, an organic solvent (alcohol, ethers and the like), surfactants, a resin binder, inorganic particles, organic particles and other radiation shielding materials. In addition, it is preferable to use titanium compounds of titanium, titanium oxide simultaneously and the like. This can further improve a shielding performance of ultraviolet rays.

A preferred manufacturing method of the above-described radiation shielding materials includes a calcination process of mixing and baking silicon compounds, strontium compounds, magnesium compounds, europium compounds and dysprosium compounds. More specifically, for example, the radiation shielding materials can be manufactured through mixing and sintering processes of silicon oxide, strontium carbonate ($SrCO_3$), magnesium oxide (MgO), europium oxide ($Eu_2O_3$), and dysprosium oxide ($Dy_2O_3$). As the silicon oxide, either silicon dioxide ($SiO_2$) or silicon monoxide (SiO) may be used, but silicon dioxide ($SiO_2$) is preferably used in the radiation shielding materials.

A mixing ratio is not particularly limited. For example, it may be set in which silicon oxide is 20 to 60 mass % (preferably 30 to 50 mass %), strontium carbonate is to 60 mass % (preferably 30 to 50 mass %), magnesium oxide is 5 to 40 mass % (preferably 10 to 30 mass %), europium oxide is 0.1 to 5 mass % (preferably 0.2 to 1 mass %) and dysprosium oxide is 0.1 to 5 mass % (preferably 0.2 to 1 mass %).

In addition to the above-described raw materials, boron compounds of boric acid ($H_3BO_3$) may be further added thereto. This facilitates electron transfer between metals during the firing, thereby enabling acceleration in an oxidation-reduction effect. A mixing amount of boric acid is not particularly limited, but is preferably 0.1 to 5 mass %, and more preferably 0.5 to 3 mass %. After being mixed, the above-described raw materials may be pulverized by using a grinder such as a ball mill and a rod mill. The materials may not be pulverized, but in a case of the above-described radiation shielding materials, it is preferable to pulverize the materials. For example, a firing temperature may be set to 500° C. to 2,000° C. in an electric furnace, and preferably 1,000° C. to 1,500° C. Firing atmosphere may be either air atmosphere or an inert gas, but is preferably air atmosphere.

The firing time may be appropriately determined depending on a firing temperature and firing atmosphere, but for example, may be set to 10 minutes to 10 hours, and preferably 30 minutes to 5 hours. After the firing process, it is preferable to further add a plasma sintering process. This can improve X-ray absorption to be obtained from the radiation shielding materials.

The plasma sintering may be performed according to the related art, and for example, may be performed at 500° C. to 2,000° C. (preferably 700° C. to 1500° C.) by using a plasma sintering machine. The sintering time may be appropriately determined depending on a sintering temperature, but for example, may be set to 5 minutes to 2 hours, and preferably 10 minutes to 1 hour.

The above-described radiation shielding materials will be further described in detail by using the following examples. Incidentally, the above-described radiation shielding materials are not limited to the following examples.

Example 1 of Radiation Shielding Materials $SiO_2$ (manufactured by Iwai Chemicals Co., Ltd) of 40 mass %, $SrCO_3$ (manufactured by Honjo Chemical Corporation) of 38.2 mass %, MgO (manufactured by Ube Material Industries, LTD.) of 20 mass %, $Eu_2O_3$ (manufactured by NeoMag Co., Ltd.) of 0.4 mass %, $Dy_2O_3$ (manufactured by NeoMag Co., Ltd.) of 0.4 mass % and $H_3BO_3$ (manufactured by Iwai Chemicals Co., Ltd) of 1 mass % were placed in a ball mill mixer, and were mixed for one hour. Then, the materials were placed in an electric furnace, and firing was performed under the conditions of air atmosphere, 1,300° C. and two hours. After the firing, the materials were naturally cooled to a room temperature, and were pulverized by using the ball mill mixer so that an average particle size thereof became 7 μm. In this manner, the radiation shielding materials in Example 1 were obtained.

A composition ratio of the radiation shielding materials in Example 1 was measured. The measured result was Si of 13.3 mass %, Sr of 42.4 mass %, Mg of 6.23 mass %, Eu of 0.84 mass % Dy of 1.83 mass %, 0 (oxygen atom) of 31.3 mass %, and the remaining was impurities.

The measured result of the specific gravity was 3.7 g/cm$^3$. A qualitative analysis and a fluorescent X-ray analysis were performed in measurement by using an X-ray diffraction apparatus. As a result, Example 1 described above estimated the radiation shielding materials to be $Sr_2MgSi_2O_7.Eu^{3+}$, $Dy^{3+}$.

Example 2 of Radiation Shielding Materials

For the radiation shielding materials obtained in Example 1, sintering was further performed at 1,000° C. for approximately 30 minutes by using a plasma sintering machine (manufactured by SPS Syntax Inc., Model No.: SPS-1030). After the sintering, the radiation shielding materials were naturally cooled to a room temperature, and radiation shielding materials (pellet shape and thickness of 3 mm) in Example 2 were obtained.

Comparative Examples of Radiation Shielding Materials

A lead plate (thickness of 0.3 mm, commercially available) and an aluminum plate (thickness of 3 mm, commercially available) were respectively used in Comparative Example 1 and Comparative Example 2. X-ray Shielding Performance of Radiation Shielding Materials (X-ray Transmission Measurement)

The radiation shielding materials in Example 1 were further processed in a pellet shape (thickness of 3.95 mm) by using a press machine. According to a transmission method, an X-ray transmittance rate was measured for samples of Examples 1 and 2 and Comparative Examples 1 and 2 under a condition in which measured energy was 50 keV, and then a linear absorption coefficient was calculated by using the transmittance rate. The linear absorption coefficient is calculated by dividing the thickness of the sample (cm) from a value obtained by taking natural logarithm of the transmittance rate. The obtained measurement results are illustrated in Table 1.

TABLE 1

| | Thickness of Sample | Transmittance Rate | Linear Absorption Coefficient (μ/cm) |
|---|---|---|---|
| Example 1 | 3.95 mm (pellet) | 0.062 | 7.0 |
| Example 2 | 3 mm (pellet) | 0.055 | 9.7 |
| Comparative Example 1 | 0.3 mm (lead plate) | 0.064 | 91.8 |
| Comparative Example 2 | 3 mm (aluminum plate) | 0.74 | 1.0 |

Ultraviolet Shielding Performance of Radiation Shielding Materials (UV Transmission Measurement)

A transmission rate of ultraviolet rays in Example 1 was measured by using an ultraviolet and visible spectrophotometer (manufactured by Shimadzu Corporation, Model No.: UV2400PC). As a result, in a wavelength of 250 nm to 400 nm, the transmittance rate was 20% or less.

The above-described result shows an excellent linear absorption coefficient, since in Examples 1 and 2 of the radiation shielding materials, it is possible to obtain a sufficiently low transmittance rate with a practical thickness, although the radiation shielding materials cannot compete with lead which is excellent as the X-ray shielding material in Comparative Example 1. In particular, when compared to aluminum in Comparative Example 2, it is appreciated that the radiation shielding materials sufficiently have an excellent linear absorption coefficient.

In addition, in Example 1 of the radiation shielding materials, it is appreciated that the ultraviolet shielding performance is excellent since the transmittance rate of the ultraviolet rays is low. Furthermore, there is an advantageous effect against electron beams.

In addition, the radiation shielding materials have the significantly lower specific gravity than the specific gravity of lead (11.34), and are excellent in workability since the radiation shielding materials can be easily deformed in a granular shape or a plate shape. Therefore, it is appreciated that the radiation shielding materials can be used in various applications or forms.

Second Embodiment

Figure 11:
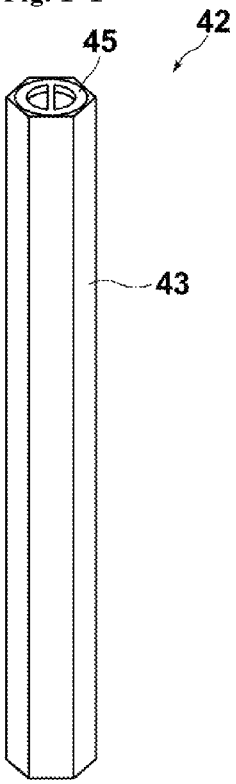
FIG. 11 is a perspective view of a radioactive contaminant container according to the second embodiment.

The radioactive contaminant container 1 may directly contain the radioactive contaminants according to the first embodiment, or may contain the other radioactive contaminant containers after the radioactive contaminants are contained in the other radioactive contaminant containers. FIG. 10 illustrates a state where the radioactive contaminant container 1 according to the first embodiment contains multiple radioactive contaminant containers 42 according to a second embodiment. FIG. 11 illustrates a perspective view of the radioactive contaminant container 42 according to the second embodiment.

Figure 12:
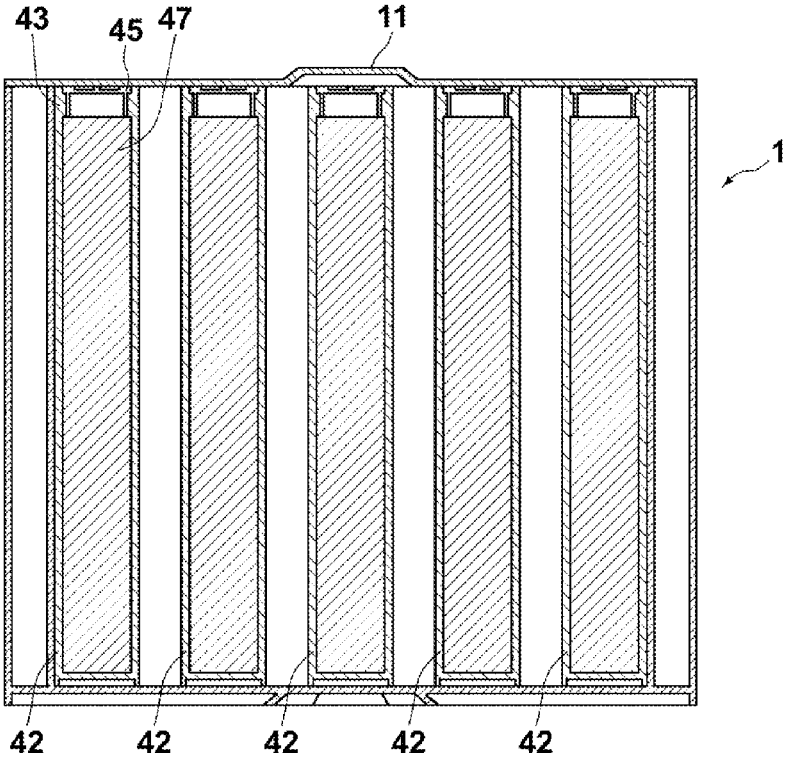
FIG. 12 is a cross-sectional view along a line C-C' in FIG. 10 in a case where a lid is closed in the radioactive contaminant container according to the first embodiment which contains multiple radioactive contaminant containers according to the second embodiment.
Figure 1:
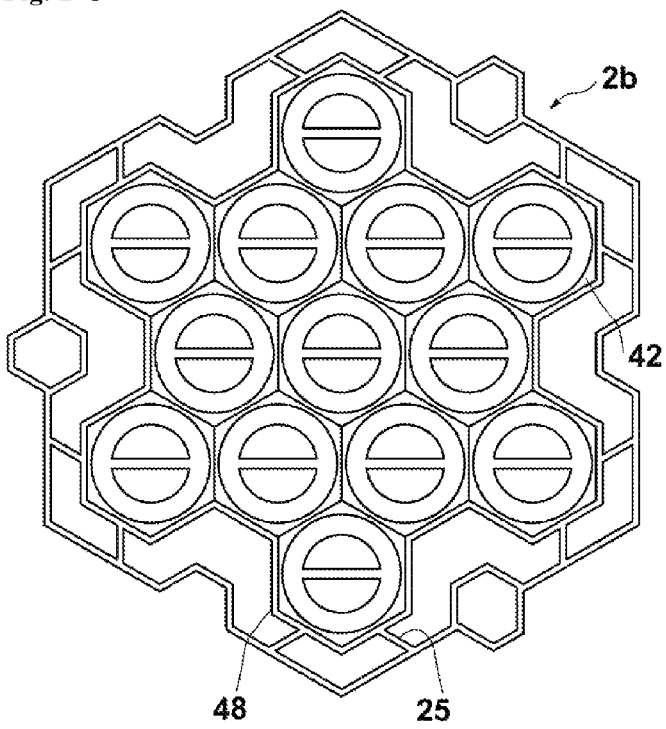
Figure 1:
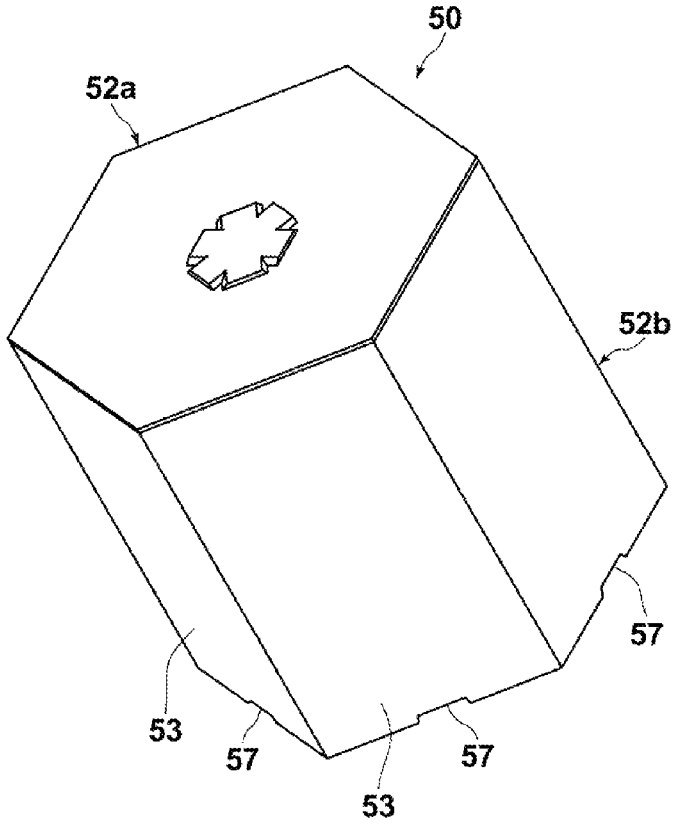
Figure 1:
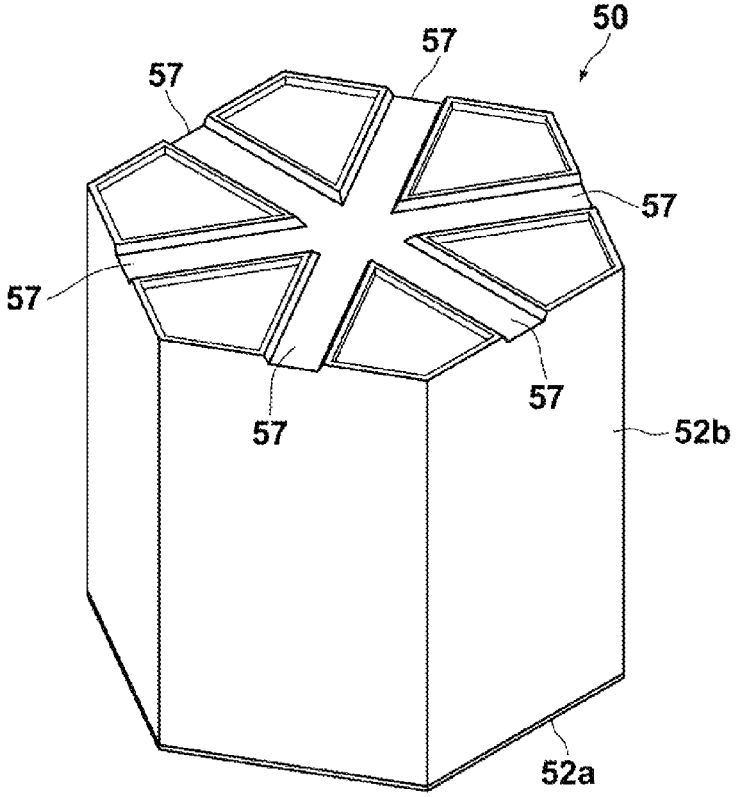
Figure 1:
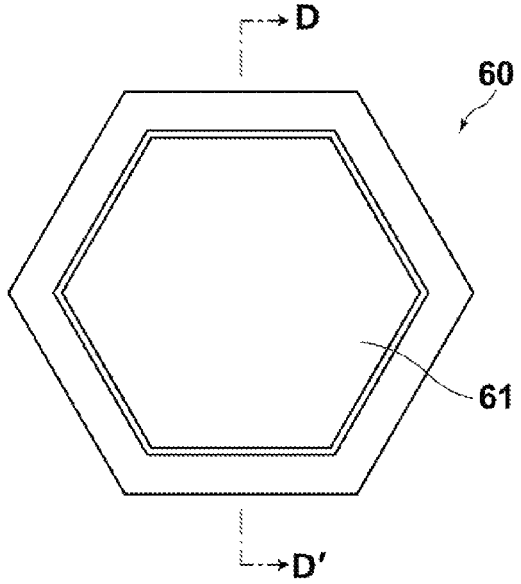

As illustrated in FIG. 11, the radioactive contaminant container 42 according to the second embodiment includes a wall having a main body 43 and a lid 45. The outer shape of the wall is a substantially regular hexagonal cylinder. The lid 45 is attachable to and detachable from the main body 43. A containing space defined by the main body 43 and the lid 45 can contain the radioactive contaminants. FIG. 12 illustrates the cross-sectional view along the line C-C' illustrated in FIG. 10 together with the lid 2*a* on the assumption that the lid 2*a* is in a closed state. The lid placing projection 29 (refer to FIG. 5) of the lid 2*a* according to the first embodiment is omitted in the illustration. As an example, the radioactive contaminant container 42 according to the second embodiment contains a reverse osmosis membrane (RO membrane) 47 contaminated by the radioactive materials. In some cases, the reverse osmosis membrane (RO membrane) 47 is used when purifying water contaminated by the radioactive materials. The reverse osmosis membrane (RO membrane) 47 becomes the radioactive contaminants after purifying the contaminated water.

In the radioactive contaminant container 42 according to the second embodiment, the outer shape configured to have the lid 45 and the main body 43 is a substantially hexagonal cylinder. Accordingly, when multiple radioactive contaminant containers 42 are juxtaposed, the adjacent radioactive contaminant containers 42 can be juxtaposed in close contact with each other. Therefore, as illustrated in FIG. 10, it is possible to contain more radioactive contaminant containers 42 by using a specified space.

In addition, the length of one side of the substantially hexagon appearing on the plane side and the bottom surface side of the radioactive contaminant container 42 according to the second embodiment is substantially the same as the length of each side of the inner side appearing on the cross-sectional surface of the inner wall surface which defines the containing space 23 (refer to FIG. 6) in the radioactive contaminant container 1 according to the first embodiment. Accordingly, without causing an extra empty space to be made in the containing space 23 of the radioactive contaminant container 1 according to the first embodiment, it is possible to contain more radioactive contaminant containers 42 according to the second embodiment. In order to smoothly contain the radioactive contaminant containers 42 according to the second embodiment, as an example, a space of approximately 3 mm may be disposed between the adjacent radioactive contaminant containers 42.

Another Embodiment

Hitherto, the embodiments of the present invention have been described. However, the present invention is not limited to the above-described embodiments, and can be modified and changed in various forms based on the technical spirit of the present invention. For example, in the radioactive contaminant container 1 according to the first embodiment, the shape of the inner wall surface which defines the containing space 23 is not limited to the shape (refer to FIG. 6 and the like) illustrated as above. For example, the illustrated example in FIG. 10 adopts the shape of the inner wall surface which allows fifty five pieces of the radioactive contaminant container 42 according to the second embodiment which is to be contained, but may adopt the shape of the inner wall surface which allows fewer pieces of the radioactive contaminant container 42 according to the second embodiment which is to be contained without causing the extra empty space to be made in the containing space 23. An example is illustrated in FIG. 13.

In the example illustrated in FIG. 13, each area of the radioactive contaminant container 42 according to the second embodiment which occupies the opening area of the radioactive contaminant container 1 according to the first embodiment is larger than the area of the example illustrated in FIG. 10. Therefore, an inner wall surface 48 continuous with the inner wall 25 is further disposed inside the radioactive contaminant container 1 according to the first embodiment. The length of each side of the inside appearing on the cross-sectional surface of the further disposed inner wall surface 48 which defines the containing space 23 is designed to be substantially the same as the length of one side of the substantially hexagon appearing on the plane and the bottom surface side of the radioactive contaminant container 42 according to the second embodiment in FIG. 13. In addition, as another example, the shape of the inner wall surface which allows more radioactive contaminant containers 42 according to the second embodiment than the example illustrated in FIG. 10 to be contained may be adopted as another example.

The radioactive contaminant container 1 according to the first embodiment can contain various radioactive contaminants or containers which contain radioactive contaminants, in addition to the radioactive contaminant container 42 according to the second embodiment. Therefore, depending on a shape and a nature of materials to be contained, it is possible to appropriately determine which form is suitable for the opening of the containing space in the radioactive contaminant container 1 according to the first embodiment.

The wall of the radioactive contaminant container 1 according to the first embodiment includes the outward protrusion 6*b* extending along the axial direction and protruding outward, and the lateral surface recess 7 extending along the axial direction and recessed inward, but without being limited thereto, and may not include the outward protrusion 6*b* and the lateral surface recess 7. FIGS. 14 and 15 illustrate a perspective view of a radioactive contaminant container 50 according to another embodiment. FIG. 14 is a perspective view when viewed from the plane side, and FIG. 15 is a perspective view when viewed from the bottom surface side.

The radioactive contaminant container 50 according to another embodiment does not include the outward protrusion 6*b* extending along the axial direction and protruding outward, and the lateral surface recess 7 extending along the axial direction and recessed inward. The other configurations are the same as those of the radioactive contaminant container 1 according to the first embodiment. The shape of the wall of the radioactive contaminant container 50 which is configured to have a lid 52*a* and a main body 52*b* is a substantially regular hexagonal cylinder. A bottom surface end portion recess 57 is formed on the bottom surface side of the place corresponding to the outward protrusion 6*b* and the lateral surface recess 7 of the radioactive contaminant container 1 according to the first embodiment.

Figure 17:
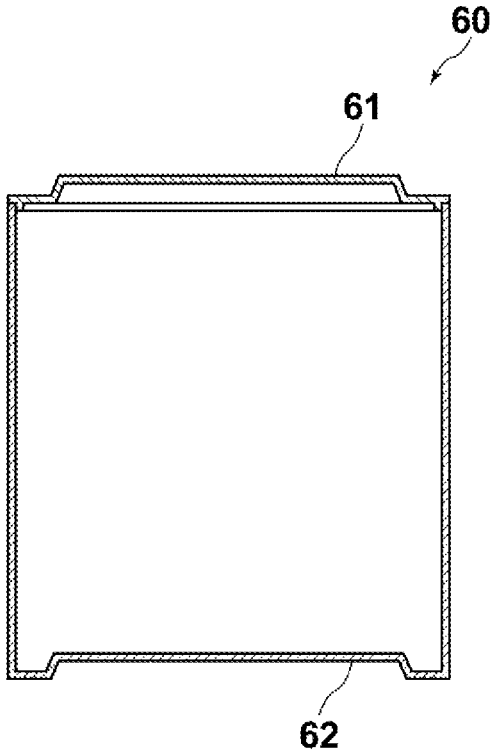
FIG. 17 is a cross-sectional view of a radioactive contaminant container according to still further another embodiment along a line D-D' in FIG. 16.

The radioactive contaminant container 1 according to the first embodiment includes the bottom surface recess formed by disposing the bottom surface projection 14, and the lid center projection 11, but without being limited thereto, may not include the above-described bottom surface recess and the lid center projection 11. In addition, even when the bottom surface recess and the lid center projection 11 are included, the shapes thereof are not limited thereto. FIG. 16 illustrates a plan view of a radioactive contaminant container 60 according to further another embodiment. FIG. 17 illustrates a cross-sectional view along the line D-D' in FIG. 16.

The outer shape of the radioactive contaminant container 60 is a substantially regular hexagonal cylinder. A lid center projection 61 whose cross-sectional surface parallel to an upper surface of the lid is a regular hexagon is disposed on the upper surface of the lid. The lateral surface of the lid center projection 61 is tilted so that the area of the above-described cross-sectional surface of the lid center projection 61 becomes narrower as it goes outward. A bottom surface recess 62 whose cross-sectional surface is a hexagon is formed on the bottom surface of the radioactive contaminant container 60. Accordingly, the lid center projection 61 of the other radioactive contaminant container 60 can be fitted to the bottom surface recess 62.

In addition, as another example, without disposing the projections and the recesses such as the outward protrusion 6*b*, the lateral surface recess 7, the lid center projection 11 and the bottom surface recess on the walls 2 of radioactive contaminant container 1, a radioactive contaminant container may be configured to include a wall of a hexagonal cylinder including a regular hexagonal cylinder.

The radioactive contaminant container 42 according to the second embodiment does not include the projection and the recess for being connected to the other radioactive contaminant container 42, but is not limited thereto. Similarly to the radioactive contaminant container 1 according to the first embodiment, the projection and the recess for being connected to the other radioactive contaminant container 42 may be included.

In the first and second embodiments, the lids 2*a* and 45 are disposed to be attachable to and detachable from the main bodies 2*b* and 43, but are not limited thereto. For example, the lids 2*a* and 45 may be disposed to be openable and closeable with respect to the main bodies 2*b* and 43.

In the first and second embodiments, the description has been made for clarity of the description by defining the upper surface and the bottom surface, in the positional relationship when the wall of the substantially hexagonal cylinder is placed in the upright position so that the axial direction y in FIG. 2 is perpendicular to the placement surface, but is not limited thereto. Multiple radioactive contaminant containers may be juxtaposed or stacked on one another so that the axial direction y is perpendicular to the placement surface. In this case, it is preferable that the lid be bonded to the main body after the radioactive contaminants are contained or the lid be formed on the surface located above when the radioactive contaminant container is placed.

The wall 2 of the radioactive contaminant container 1 according to the first embodiment adopts a three-layer structure where the intermediate layer 31 formed of the radiation shielding material is interposed between the outer and inner stainless steel layers 30 and 32, but is not limited thereto. For example, a two-layer structure may be adopted where a stainless steel layer is arranged outside and a radiation shielding material-added layer formed by adding a radiation shielding material to a resin or rubber is arranged inside. Similarly, the wall of the radioactive contaminant container 42 according to the second embodiment may also adopt the three-layer structure where the intermediate layer 31 formed of the radiation shielding material is interposed between the outer and inner stainless steel layers 30 and 32, or may also adopt the two-layer structure where the stainless steel layer is arranged outside and the radiation shielding material-added layer formed by adding the radiation shielding material to the resin or rubber is arranged inside. The other configuration may be adopted.

In addition, without using the radiation shielding material, the wall 2 of the radioactive contaminant container 1 may be formed of other materials such as stainless steel. For example, even when the wall 2 of the radioactive contaminant container 1 is formed of only the stainless steel, depending on the thickness of the wall 2, it is possible to shield at least a portion of radiation. When multiple radioactive contaminant containers 1 are juxtaposed, total thickness of the adjacent walls 2 are twice the thickness of the single wall 2, thereby further improving the radiation shielding function. Similarly, without using the radiation shielding material, the wall of the radioactive contaminant container 42 according to the second embodiment may be formed of other materials such as the stainless steel.

In addition, with regard to the radiation shielding materials, the radiation shielding material has been described which has been independently developed by the applicant, but without being limited thereto, other materials having the radiation shielding function may be used as the radiation shielding material.

In the radioactive contaminant container 1 according to the first embodiment described above, when the lid 2*a* is attached to the main body 2*b*, the outer edge of the lid recess 10 of the lid 2*a* may be formed so as to expose a portion of the plane side end portion of the lateral surface recess 7, and a handle may be attached to the plane side end portion of the exposed lateral surface recess 7. The handle is sometimes referred to as a lifting point. When lifting, transporting and installing the radioactive contaminant container 1, it is possible to lift the radioactive contaminant container 1 by attaching a wire rope to the handle. The handle is attached to the three places of lateral surface recess 7 which are disposed on three surfaces not adjacent to each other among six surfaces extending in the axial direction of the substantially hexagonal cylinder. Accordingly, the radioactive contaminant container 1 can be lifted, transported and installed with a good balance. Furthermore, when a partition is disposed in the storing space of the radioactive contaminant container 1, it is possible to fix the handle to the partition in order to prevent falling of the radioactive contaminant container 1. As an example, the shape of the handle is a U-shape, but without being limited thereto, may be any shape if the wire rope can be attached thereto. It is preferable that the height width of the handle be configured so as not to interfere with the fitting to the other radioactive contaminant container 1 when stacking the radioactive contaminant containers 1 on one another.

What is claimed is:

1. A radioactive contaminant container comprising:

a wall that defines a containing space for containing radioactive contaminants and shields at least a portion of radiation irradiated from the radioactive contaminants, wherein the wall has an outer shape of a hexagonal cylinder or a substantially hexagonal cylinder, wherein the wall includes a first protrusion extending along an axial direction of the hexagonal cylinder or the substantially hexagonal cylinder and protruding outward; and a first recess extending along the axial direction and recessed inward, and wherein the first recess can be fitted to the first protrusion formed in the other radioactive contaminant container.

2. The radioactive contaminant container according to claim 1, wherein the wall includes a first surface and a second surface, each extending in a direction intersecting with the axial direction of the hexagonal cylinder or the substantially hexagonal cylinder, and each shape being hexagonal or substantially hexagonal, wherein any one surface of the first surface and the second surface includes a second protrusion protruding outward, and the other surface includes a second recess recessed inward, and wherein the second recess can be fitted to the second protrusion formed in the other radioactive contaminant container.

3. The radioactive contaminant container according to claim 1, wherein the wall includes a metal plate having multiple through-holes.

4. The radioactive contaminant container according to claim 1, wherein a portion of the wall is formed to be attachable to and detachable from the other portion of the wall, or to be openable and closeable in order to contain the radioactive contaminants in the containing space.

5. The radioactive contaminant container according to claim 1, wherein the wall includes a layer containing radiation shielding materials having at least silicon, strontium, magnesium, europium and dysprosium as essential elements.

6. The radioactive contaminant container according to claim 5, wherein the wall further includes a layer formed of stainless steel.

7. The radioactive contaminant container according to claim 5, wherein the layer containing the radiation shielding materials is a layer in which the radiation shielding materials are added to resin or rubber.

8. The radioactive contaminant container according to claim 1, wherein the wall is formed of stainless steel.

9. The radioactive contaminant container according to claim 1, wherein the radioactive contaminant container contains a reverse osmosis membrane used to purify radioactively contaminated water.

10. A radioactive contaminant container, wherein a containing space for containing radioactive contaminants contains multiple radioactive contaminant containers according to claim 9.

11. The radioactive contaminant container according to claim 1, wherein the first recess is disposed on three surfaces which are not adjacent to each other within six surfaces extending in the axial direction of the hexagonal cylinder or the substantially hexagonal cylinder, and wherein a handle for attaching a wire rope for transportation is disposed in the first recess.

* * * * *